US005774038A

United States Patent [19]

Welch et al.

[11] Patent Number: 5,774,038

[45] Date of Patent: Jun. 30, 1998

[54] SAFETY MONITOR

[76] Inventors: Dana L. Welch; Mark A. Welch; Shirley A. McCoy, all of 4600 Maple Ridge Rd., Sterling, Mich. 48659

[21] Appl. No.: 674,257

[22] Filed: Jul. 1, 1996

[51] Int. Cl.[6] ..... G08B 23/00

[52] U.S. Cl. ..... 340/286.05; 340/628; 340/632; 340/573

[58] Field of Search ..... 340/286.05, 627, 340/628, 629, 630, 632, 573

[56] References Cited

U.S. PATENT DOCUMENTS

| | | | |
|---|---|---|---|
| D. 371,779 | 7/1996 | Nowak et al. | D14/137 |
| D. 376,764 | 12/1996 | Barnes | D10/104 |
| 5,159,315 | 10/1992 | Schultz et al. | 340/539 |
| 5,446,934 | 9/1995 | Frazier | 5/655 |
| 5,512,880 | 4/1996 | Abrams et al. | 340/573 |
| 5,566,362 | 10/1996 | Bauer et al. | 455/90 |

*Primary Examiner*—Jeffery Hofsass
*Assistant Examiner*—Ashok Mannava
*Attorney, Agent, or Firm*—Michael I. Kroll

[57] ABSTRACT

The present invention relates to a improved safety monitor (10) which comprises a main monitor (12) and a remote monitor (14) which are in two way communication with each other. The main monitor (12) has a main monitor detector (12J) and a main monitor fire/smoke alarm (12K) integrally electronically connected to a main monitor microprocessor (12F). The main monitor detector (12J) is selected from a group consisting of monitor carbon monoxide detector, monitor carbon dioxide detector, and monitor radon detector. The main monitor detector (12J) and the main monitor fire/smoke alarm (12K) send a warning signal to the remote monitor (14) to alert the user of an adverse condition and which type. A charger base (16) is provided to hold the main monitor (12) and the remote monitor (14) as well as charge the main monitor battery (12I) and remote monitor battery (14I).

11 Claims, 4 Drawing Sheets

SAFETY MONITOR

BACKGROUND OF THE INVENTION

1. Field of the Invention

The present invention relates to an improved safety monitor. More particularly, the present invention relates to an improved safety monitor having a portable remote monitor containing a carbon monoxide detector, a carbon dioxide detector, a radon detector, a fire/smoke detector, and an intercom.

2. Description of the Prior Art

Monitors such as baby monitors are widely utilized and well known in the art. The majority of monitors comprise a main unit having a speaker to constantly monitor the sounds received by a remote unit having a microphone. The main monitor and the remote monitor communicate to one another via radio transmissions utilizing a transmitter electronically incorporated in the remote monitor and a receiver electronically incorporated in the main monitor. Normally, the remote monitor is positioned near the baby, infant or child and the main monitor is positioned with the guardian, parent, in another room so that the guardian can monitor the activity of the baby, infant or child. The remote monitor is voice activated with an override switch which is a manual remote monitor intercom button.

Numerous innovations for monitoring devices have been provided in the prior art that are described as follows. Even though these innovations may be suitable for the specific individual purposes to which they address, they differ from the present invention as hereinafter contrasted.

In U.S. Pat. No. 5,210,532, titled, BABY MONITOR RECEIVER HAVING INDICATOR DISPLAY AND DUAL POSITIONED CLIP, by inventor, Knoedler, a baby monitor receiver is provided for use in combination with a transmitter unit. The patented invention differs from the present invention because it lacks the following: a remote monitor transmitter, a remote monitor detector indicator, a remote monitor intercom button, a main monitor light, a main monitor light photocell, a main monitor transmitter, a main monitor detector, a main monitor intercom button, and a charger base.

In U.S. Pat. No. 5,309,145, titled, TRAVEL CONVENIENCE AND SECURITY DEVICE, by inventor Allan C. Branch, a clock, a lamp, an alarm, a motion detector and a smoke alarm are advantageously combined in a travel device. The patented invention differs from the present invention because it lacks the following: a charger base, a remote monitor, a main monitor light photocell, a main monitor antenna, a main monitor speaker/microphone, a main monitor transmitter, a main monitor receiver, a main monitor detector sniffer, a main monitor detector analyzer, a main monitor detector microprocessor, a main monitor detector indicator, and a main monitor intercom button.

In U.S. Pat. No. 5,461,365, titled, MULTI-HAZARD ALARM SYSTEM USING SELECTABLE POWER-LEVEL TRANSMISSION AND LOCALIZATION, by inventor Schlager et al., a personal alarm system includes a monitoring base station and at least one remote sensing unit in two-way radio communication. The patented invention differs from the present invention because it lacks the following: a main monitor light, a main monitor light photocell, a main monitor detector, a main monitor fire/smoke alarm, a remote monitor light, a remote monitor light photocell, a remote monitor detector indicator, and a charger base.

Numerous innovations for monitors have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to an improved safety monitor. More particularly, the present invention relates to an improved safety monitor having a portable remote monitor containing a carbon monoxide detector, a carbon dioxide detector, a radon detector, a fire/smoke detector, and an intercom. The first and foremost advantage of the present invention is the safety of a child in the presence of a crisis. Having the main monitor detector and the main monitor fire/smoke alarm in the vicinity of the child, the sound of the alarm would be loud and ear piercing being transmitted to the remote monitor, that it would wake the most sound sleeper. In addition, many homes and apartments still do not have fire/smoke alarms.

The types of problems encountered in the prior art are monitors lack alarm means to protect a child as well as two-way communication means.

In the prior art, unsuccessful attempts to solve this problem were attempted namely: utilizing two way communication devices. However, the problem was solved by the present invention because making a two way communication device having a main monitor detector and a main monitor fire/smoke alarm.

Innovations within the prior art are rapidly being exploited in the field of child safety.

The present invention went contrary to the teaching of the art which teaches separate monitors and alarms.

The present invention solved a long felt need to increase the safety of a child in the event of a crisis such as fire and smoke.

The present invention produced unexpected results namely: the improved safety monitor could be utilized by travelers as a portable alarm system.

A synergistic effect was produced utilizing the present invention due to the following facts and results from experimentation: the two way communication means resulted in better behaved children because the parent or guardian could constantly monitor and reprimand the child.

Accordingly, it is an object of the present invention to provide a main monitor which comprises a main monitor indicator light which functions to show the user if the device is working properly.

More particularly, it is an object of the present invention to provide a main monitor battery as a preferred power means. The main monitor battery has a main monitor battery positive lead and a main monitor battery negative lead.

In keeping with these objects, and with others which will become apparent hereinafter, one feature of the present invention resides, briefly stated, in the main monitor battery is electrically connected to a main monitor microprocessor.

When the main monitor microprocessor is designed in accordance with the present invention, is electrically connected to the following: a main monitor switch having main monitor switch indicia, a main monitor light electrically coupled to a main monitor light photocell, a main monitor antenna, a main monitor speaker/microphone, a main monitor transmitter, a main monitor receiver, a main monitor detector microprocessor of a main monitor detector, a main monitor fire/smoke alarm microprocessor of a main monitor fire/smoke alarm, and a main monitor intercom button.

In accordance with another feature of the present invention, the main monitor detector has a main monitor detector sniffer integrally coupled to a main monitor detector analyzer.

Another feature of the present invention is that the main monitor detector has a main monitor detector indicator which functions to show the user if the main monitor detector is working properly.

Yet another feature of the present invention is that the main monitor fire/smoke alarm has a main monitor fire/smoke alarm sniffer and a main monitor fire/smoke alarm analyzer.

Still another feature of the present invention is that the main monitor fire/smoke alarm has a main monitor fire/smoke alarm indicator which functions to tell the user if the main monitor fire/smoke alarm is working properly.

Yet still another feature of the present invention is that the main monitor has a main monitor handle which facilitates portability.

Still yet another feature of the present invention is that the remote monitor has a power means which is preferably a remote monitor battery having a remote monitor battery positive lead and a remote monitor battery negative lead.

Another feature of the present invention is that the remote monitor battery is electronically connected to a remote monitor microprocessor.

Yet another feature of the present invention is that the remote monitor microprocessor is electronically connected to the following: a remote monitor indicator light, a remote monitor switch having remote monitor switch indicia, a remote monitor light coupled to a remote monitor light photocell, a remote monitor antenna, a remote monitor speaker/microphone, a remote monitor transmitter, a remote monitor receiver, a remote monitor detector indicator, and a remote monitor intercom button.

Still another feature of the present invention is that the remote monitor detector indicator has a remote monitor carbon monoxide detector indicator, a remote monitor carbon dioxide detector indicator, and a remote monitor radon detector indicator as well as a remote monitor fire/smoke detector indicator.

Yet still another feature of the present invention is that the charger base comprises a charger base horizontal member securely fastened to a charger base vertical member.

Still yet another feature of the present invention is that the charger base horizontal member has a charger base converter which is electrically connected to a charger base plug which is preferably posited within the charger base vertical member.

Another feature of the present invention is that the charger base converter is electrically connected to the following: a charger base switch having charger base switch indicia, a charger base light coupled to a charger base light photo cell, charger base main monitor holder positive lead, a charger base main monitor holder negative lead, a charger base remote monitor holder positive lead, and charger base remote monitor holder negative lead.

Yet another feature of the present invention is that the charger base has a charger base main monitor holder which contains the charger base main monitor holder positive lead and the charger base main monitor holder negative lead as well as a charger base remote monitor holder which contains a charger base remote monitor holder positive lead and a charger base remote monitor holder negative lead.

The novel features which are considered characteristic for the invention are set forth in the appended claims. The invention itself however, both as to its construction and its method of operation, together with additional objects and advantages thereof, will be best understood from the following description of the specific embodiments when read and understood in connection with the accompanying drawings.

DESCRIPTION OF THE PREFERRED EMBODIMENT

Figure 1:
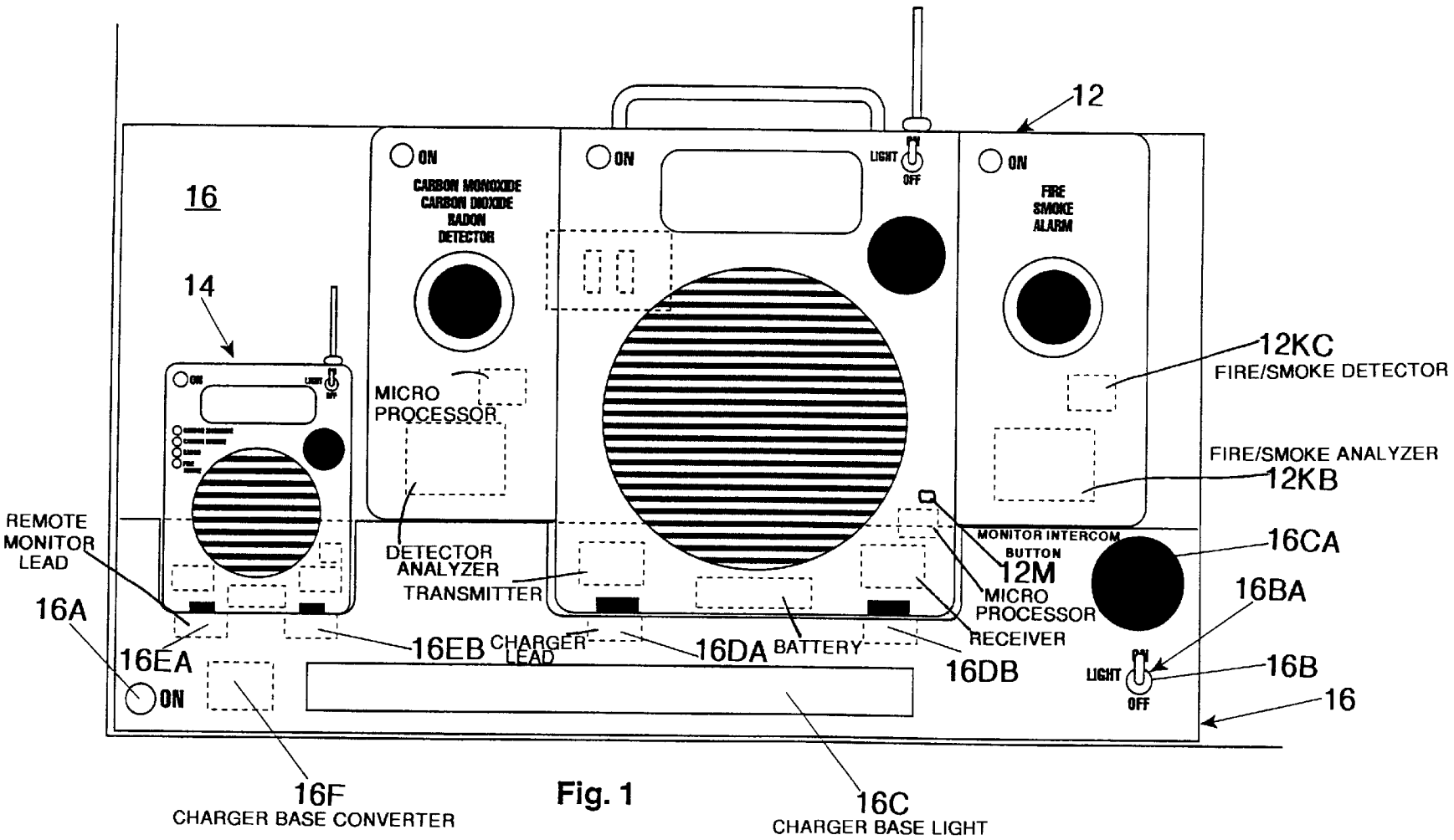
FIG. 1 is a front view of a improved safety monitor (10).

Firstly, referring to FIG. 1 which is a front view of a improved safety monitor (10) which comprises a main monitor (12) which is in two way communication with a remote monitor (14) having voice activated intercom with a manual over-ride being a remote monitor intercom button. The improved safety monitor (10) further comprises a charger base (16) within which the main monitor (12) and the remote monitor (14) are held to recharge. The improved safety monitor (10) is manufactured from a group of materials consisting of metal, metal alloy, plastic, plastic composite, rubber, and rubber composite. In addition, the improved safety monitor (10) manufacturing material has a color selected from a group of colors consisting of pastel, primary, and florescent. The colors function to stimulate a baby's senses.

Figure 2A:
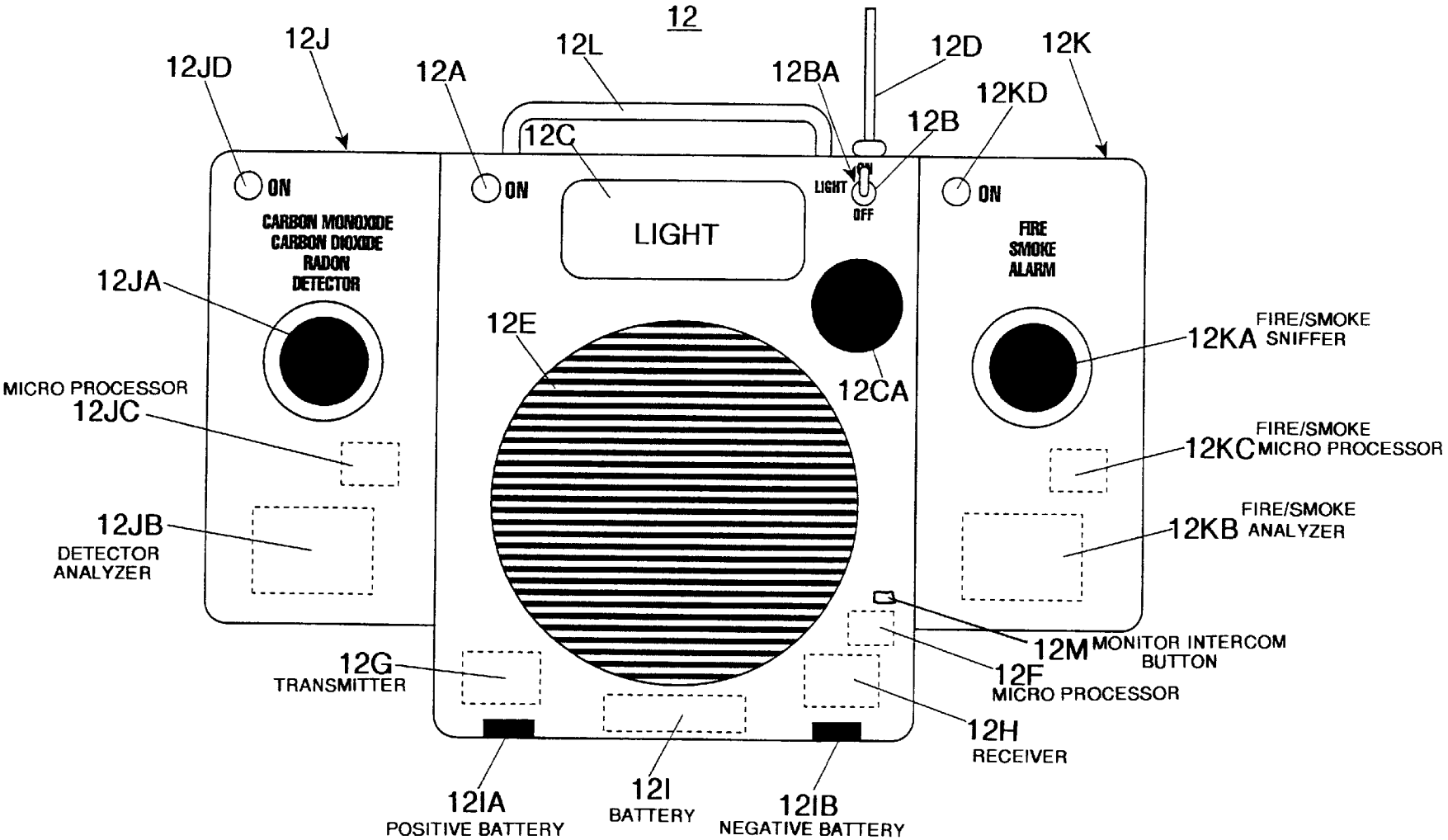
FIG. 2A is a front view of a main monitor (12).

Referring to FIG. 2A which is a front view of a main monitor (12) which comprises: a main monitor microprocessor (12F) electronically connected to a power means. The power means is preferably a main monitor battery (12I) having a main monitor battery positive lead (12IA) and a main monitor battery negative lead (12IB). The main monitor microprocessor (12F) functions as a control center for the various features of the main monitor (12). A main monitor indicator light (12A), which functions to show a user that the main monitor (12) is functioning properly, is electronically connected to the main monitor microprocessor (12F). A main monitor switch (12B) having main monitor switch indicia (12BA) (ON and OFF) is electronically connected between the main monitor microprocessor (12F) and the main monitor battery (12I). A main monitor light (12C) is electronically connected to a main monitor light photocell (12CA) which is electronically connected to the main monitor microprocessor (12F). The main monitor light photocell (12CA) functions to turn the main monitor light (12C) "ON" when it is dark such as when smoke is present. A two way communication means comprises a main monitor antenna (12D), a main monitor speaker/microphone (12E), a main monitor transmitter (12G) and a main monitor receiver (12H) which are all electronically connected to the main monitor microprocessor (12F).

A main monitor detector (12J) consists of any one, all or combination thereof of a monitor carbon monoxide detector, a monitor carbon dioxide detector, and a monitor radon detector. The main monitor detector (12J) comprises a main monitor detector sniffer (12JA) integrally coupled to a main monitor detector analyzer (12JB) which is electronically connected to a main monitor detector microprocessor (12JC) which is electronically connected to the main monitor microprocessor (12F). The main monitor detector sniffer (12JA) functions to constantly monitor the environment and feed the information into the main monitor detector analyzer (12JB) which tests the information provided. If an adverse condition is detected by the main monitor detector analyzer (12JB) an electronic signal is sent to the main monitor detector microprocessor (12JC) and then to the main monitor microprocessor (12F) which in turn sends an electronic signal to the main monitor transmitter (12G) which converts the electronic signal to a radio signal which is transmitted via the main monitor antenna (12D) to the remote monitor (14). Similarly, a main monitor intercom button (12M) is electronically connected to the main monitor microprocessor (12F) also provides two way communication with the remote monitor (14) via the main monitor speaker/microphone (12E) which is voice activated. A main monitor detector indicator (12JD) is electrically connected to the main monitor detector microprocessor (12JC). The main monitor detector indicator (12JD) shows a user if the main monitor detector (12J) is functioning properly.

A main monitor fire/smoke alarm (12K) comprises a main monitor fire/smoke alarm sniffer (12KA) integrally coupled to a main monitor fire/smoke alarm analyzer (12KB) which is electronically connected to a main monitor fire/smoke alarm microprocessor (12KC) which is electronically connected to the main monitor microprocessor (12F). The main monitor fire/smoke alarm sniffer (12KA) functions to constantly monitor the environment for smoke and fire (heat) and feed the information into the main monitor fire/smoke alarm analyzer (12KB) which tests the information provided. If an adverse condition is detected by main monitor fire/smoke alarm analyzer (12KB) an electronic signal is sent to the main monitor fire/smoke alarm microprocessor (12KC) and then to the main monitor microprocessor (12F) which in turn sends an electronic signal to the main monitor transmitter (12G) which converts the electronic signal to a radio signal which is transmitted via the main monitor antenna (12D) to the remote monitor (14).A main monitor fire/smoke alarm indicator (12KD) is electrically connected to the main monitor fire/smoke alarm microprocessor (12KC). A main monitor fire/smoke alarm indicator (12KD) functions to show a user if the main monitor fire/smoke alarm (12K) is functioning properly. The main monitor (12) has a main monitor handle (12L) which functions to facilitate portability.

Figure 2B:
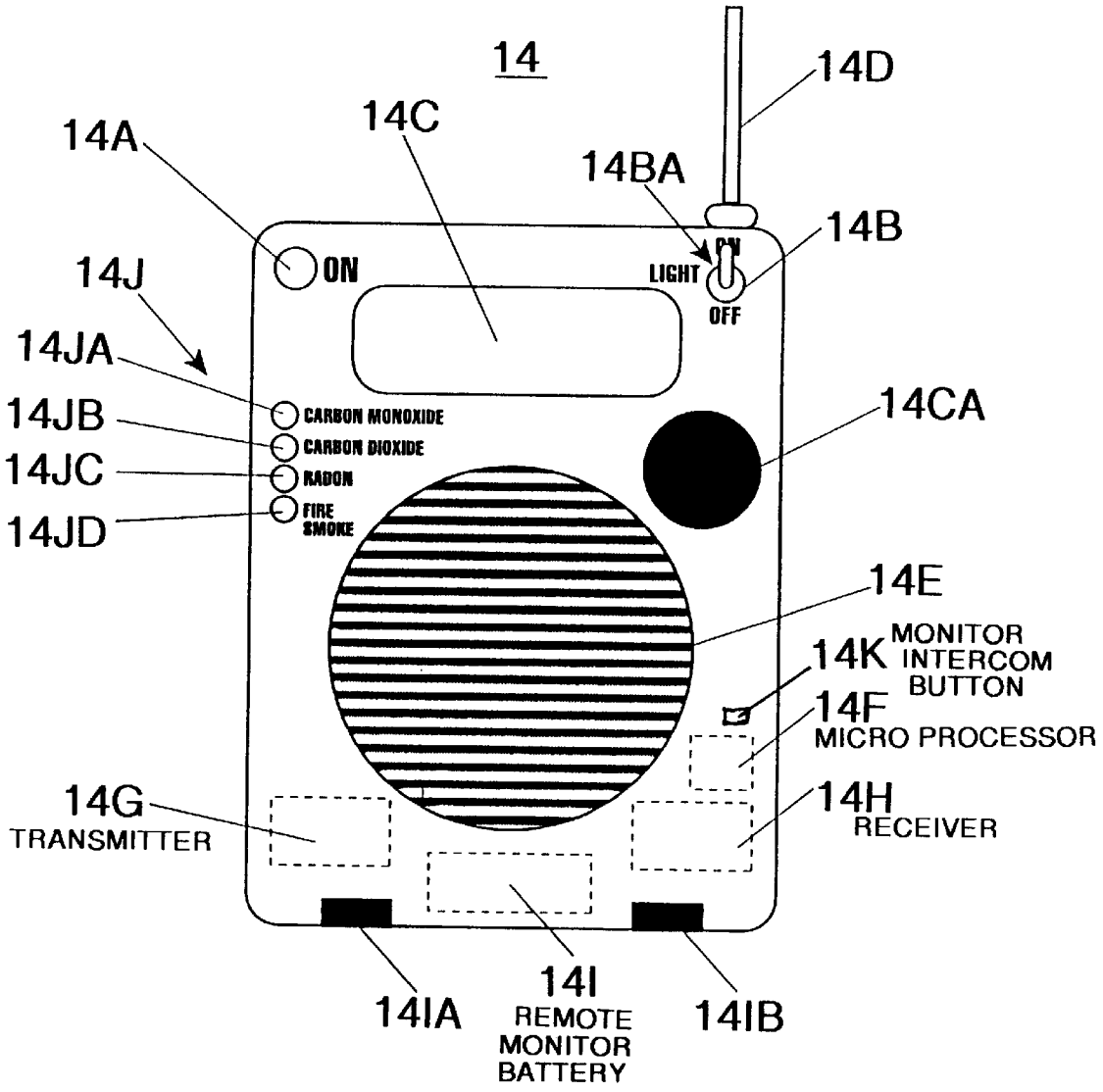
FIG. 2B is a front view of a remote monitor (14).

Now referring to FIG. 2B is a front view of a remote monitor (14) comprises a remote monitor microprocessor (14F) electronically connected to a power means which is preferably a remote monitor battery (14I) having a remote monitor battery positive lead (14IA) and a remote monitor battery negative lead (141B). A remote monitor indicator light (14A), which functions to show a user if the remote monitor (14) is functioning properly, is electronically connected to the remote monitor microprocessor (14F). A remote monitor switch (14B) having remote monitor switch indicia (14BA) is electronically connected between the remote monitor microprocessor (14F) and the power means. A remote monitor light (14C) having a remote monitor light photocell (14CA) is electronically connected to the remote monitor microprocessor (14F). The remote monitor light photocell (14CA) functions to activate the remote monitor light (14C) in darkness such as adverse conditions such as smoke. A two way communication means is established between the remote monitor (14) and the main monitor (12). The two way communication means comprises a remote monitor antenna (14D), a voice activated remote monitor speaker/microphone (14E), a remote monitor transmitter (14G), and a remote monitor receiver (14H) which are all electronically connected to the remote monitor microprocessor (14F). The remote monitor transmitter (14G) converts an electronic signal received from the remote monitor microprocessor (14F) to a radio signal transmitted through the remote monitor antenna (14D) to the main monitor antenna (12D) to the main monitor receiver (12H). The main monitor transmitter (12G) transmits a radio signal via the main monitor antenna (12D) to the remote monitor receiver (14H) which converts the radio signal received from remote monitor antenna (14D) to an electronic signal which is sent to the remote monitor microprocessor (14F).

A remote monitor detector indicator (14J) is electronically connected to the remote monitor microprocessor (14F) which receives an adverse condition indication from the main monitor (12) via the two way communication means. The remote monitor detector indicator (14J) is selected from a group consisting of a remote monitor carbon monoxide detector indicator (14JA), a remote monitor carbon dioxide detector indicator (14JB), a remote monitor radon detector indicator (14JC), and a remote monitor fire/smoke detector indicator (14JD). The remote monitor detector indicator (14J) functions to alert the user what type of adverse condition the main monitor (12) has detected.

A remote monitor intercom button (14K), functioning as an override switch for voice activation, is electronically connected to the remote monitor microprocessor (14F). A remote user can override the voice activation by depressing the remote monitor intercom button (14K) and speaking a remote user message into the voice activated remote monitor speaker/microphone (14E) which sends an electronic signal to the remote monitor microprocessor (14F) which sends an electronic signal to the remote monitor transmitter (14G) which sends a radio signal via the remote monitor antenna (14D) which is received by the main monitor antenna (12D) which sends the radio signal to the main monitor receiver (12H) which sends an electronic signal to the main monitor microprocessor (12F) which sends an electronic signal to the main monitor speaker/microphone (12E) from which a main user can hear the remote user message. A main user can depress the main monitor intercom button (12M) and speak a main user message into the main monitor speaker/microphone (12E) which sends an electronic signal to the main monitor microprocessor (12F) which sends an electronic signal to the main monitor transmitter (12G) which sends a radio signal via the main monitor antenna (12D) which is received by the remote monitor antenna (14D) which sends the radio signal to the remote monitor receiver (14H) which sends an electronic signal to the remote monitor microprocessor (14F) which sends an electronic signal to the remote monitor speaker/microphone (14E) from which a remote user can hear the main user message. In an event that a main monitor detector (12J) senses an adverse substance or condition, the main monitor detector (12J) sends an electronic signal to the main monitor microprocessor (12F) which sends an electronic signal to the main monitor transmitter (12G) which concurrently sends an alarm sound to the main monitor speaker/microphone (12E) and sends a radio signal via the main monitor antenna (12D) which is received by the remote monitor antenna (14D) which sends the radio signal to the remote monitor receiver (14H) which sends an electronic signal to the remote monitor microprocessor (14F) which sends an electronic signal to the remote monitor speaker/microphone (14E) from which a remote user can hear an alarm sound through the remote monitor speaker/microphone (14E).

Figure 2C:
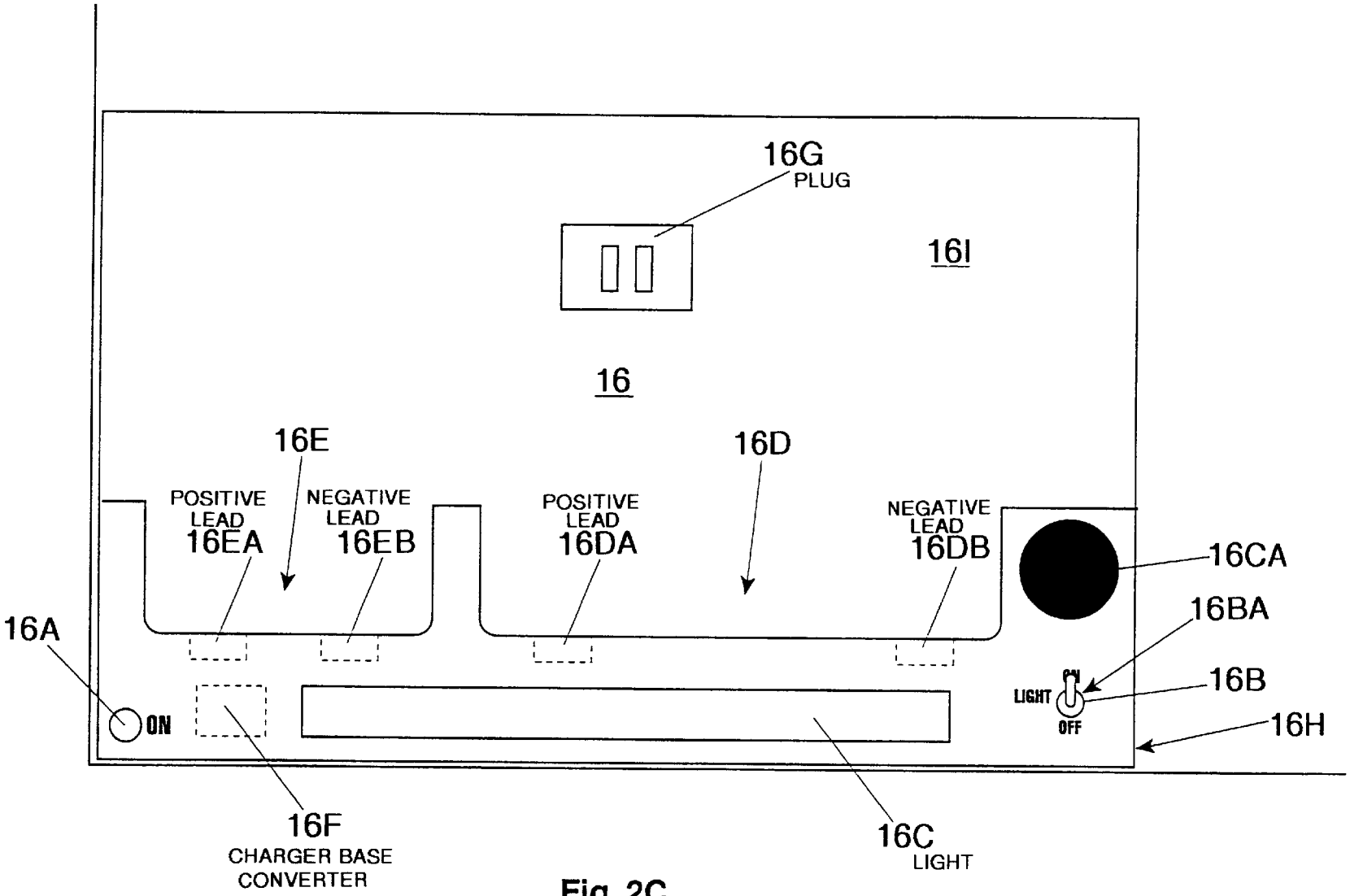
FIG. 2C is a front view of a charger base (16).

Lastly, referring to FIG. 2C which is a front view of a charger base (16) which comprises a charger base horizontal member (16H) securely fastened to a charger base vertical member (16I). The charger base horizontal member (16H) has a charger base main monitor holder (16D) and a charger base remote monitor holder (16E) therein which function to hold the main monitor (12) and the remote monitor (14), respectively. The charger base (16) further functions to electronically charge the main monitor battery (12I) and the remote monitor battery (14I). A charger base plug (16G) is preferably mounted within the charger base vertical member (16I). The charger base plug (16G) is electrically connectable to a standard power source such as a wall socket. A charger base converter (16F) is preferably mounted within the charger base horizontal member (16H). The charger base converter (16F) is electrically connected to the charger base plug (16G). A charger base switch (16B) having charger base switch indicia (16BA) is electrically connected between the to the charger base converter (16F) and the charger base plug (16G). A charger base indicator light (16A) is electrically connected to the charger base converter (16F). A charger base light (16C) having a charger base light photo cell (16CA) is electrically connected to the charger base converter (16F). The charger base light photo cell (16CA) functions to activate the charger base light (16C) when darkness occurs such as smoke. A charger base main monitor holder positive lead (16DA) and a charger base main monitor holder negative lead (16DB) are electrically connected to the charger base converter (16F) and are contained within the charger base main monitor holder (16D). A charger base remote monitor holder positive lead (16EA) and a charger base remote monitor holder negative lead (16EB) are electrically connected to the charger base converter (16F) and are contained within the charger base remote monitor holder (16E).

It will be understood that each of the elements described above, or two or more together, may also find a useful application in other types of constructions differing from the type described above.

While the invention has been illustrated and described as embodied in an improved safety monitor, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. An improved safety monitor (10) comprising:

A) a main monitor (12) which comprises:

I) a main monitor microprocessor (12F) electronically connected to a power means, a main monitor indicator light (12A) is electronically connected to the main monitor microprocessor (12F), a main monitor switch (12B) having main monitor switch indicia (12BA) is electronically connected between the main monitor microprocessor (12F) and the main power means comprising monitor battery (12I), a main monitor light (12C) is electronically connected to the main monitor microprocessor (12F), a main monitor light photocell (12CA) is electronically connected to the main monitor microprocessor (12F), a main monitor antenna (12D) is electronically connected to the main monitor microprocessor (12F), a main monitor speaker/microphone (12E) is electronically connected to the main monitor microprocessor (12F), a main monitor transmitter (12G) is electronically connected to the main monitor microprocessor (12F), a main monitor receiver (12H) is electronically connected to the main monitor microprocessor (12F), a main monitor detector (12J) is electronically connected to the main monitor microprocessor (12F), a main monitor fire/smoke alarm (12K) is electronically connected to the main monitor microprocessor (12F), a main monitor intercom button (12M) is electronically connected to the main monitor microprocessor (12F); and B) a remote monitor (14) which is in communication with the main monitor (12), the remote monitor (14) comprises:

I) a remote monitor microprocessor (14F) electronically connected to a power means, a remote monitor indicator light (14A) is electronically connected to the remote monitor microprocessor (14F), a remote monitor switch (14B) having remote monitor switch indicia (14BA) is electronically connected between the remote monitor microprocessor (14F) and the power means, a remote monitor light (14C) having a remote monitor light photocell (14CA) is electronically connected to the remote monitor microprocessor (14F), a remote monitor antenna (14D) is electronically connected to the remote monitor microprocessor (14F), a voice activated remote monitor speaker/microphone (14E) is electronically connected to the remote monitor microprocessor (14F), a remote monitor transmitter (14G) is electronically, connected to the remote monitor microprocessor (14F), a remote monitor receiver (14H) is electronically connected to the remote monitor microprocessor (14F), a remote monitor detector indicator (14J) is electronically connected to the remote monitor microprocessor (14F), the remote monitor detector indicator (14J) is selected from a group consisting of a remote monitor carbon monoxide detector indicator (14JA), a remote monitor carbon dioxide detector indicator (14JB), a remote monitor radon detector indicator (14JC), and a remote monitor fire/smoke detector indicator (14JD), a remote monitor intercom button (14K) is electronically connected to the remote monitor microprocessor (14F), a remote user can override the voice activated remote monitor speaker/microphone (14E) by depressing the remote monitor intercom button (14K) and speaking a remote user message into the remote monitor speaker/microphone (14E) which sends an electronic signal to the remote monitor microprocessor (14F) which sends an electronic signal to the remote monitor transmitter (14G) which sends a radio signal via the remote monitor antenna (14D) which is received by the main monitor antenna (12D) which sends the radio signal to the main monitor receiver (12H) which sends an electronic signal to the main monitor microprocessor (12F) which sends an electronic signal to the main monitor speaker/microphone (12E) from which a main user can hear the remote user message, a main user can depress the main monitor intercom button (12M) and speak a main user message into the main monitor speaker/microphone (12E) which sends an electronic signal to the main monitor microprocessor (12F) which sends an electronic signal to the main monitor transmitter (12G) which sends a radio signal via the main monitor antenna (12D) which is received by the remote monitor antenna (14D) which sends the radio signal to the remote monitor receiver (14H) which sends an electronic signal to the remote monitor microprocessor (14F) which sends an electronic signal to the remote monitor speaker/microphone (14E) from which a remote user can hear the main user message, in an event that a main monitor detector (12J) senses an adverse substance, the main monitor detector (12J) sends an electronic signal to the main monitor microprocessor (12P) which sends an electronic signal to the main monitor transmitter (12G) which concurrently sends an alarm sound to the main monitor speaker/microphone (12E) and sends a radio signal via the main monitor antenna (12D) which is received by the remote monitor antenna (14D) which sends the radio signal to the remote monitor receiver (14H) which sends an electronic signal to the remote monitor microprocessor (14F) which sends an electronic signal to the remote monitor speaker/microphone (14E) from which a remote user can hear an alarm sound through the remote monitor speaker/microphone (14E).

2. The improved safety monitor (10) as described in claim 1, wherein the main power means is a main monitor battery (12I) having a main monitor battery positive lead (12IA) and a main monitor battery negative lead (12IB).

3. The improved safety monitor (10) as described in claim 1, wherein the main monitor detector (12J) comprises a main monitor detector sniffer (12JA) which is electronically connected to a main monitor detector analyzer (12JB) which is electronically connected to a main monitor detector microprocessor (12JC) which is electronically connected to the main monitor microprocessor (12F).

4. The improved safety monitor (10) as described in claim 1, wherein the main monitor fire/smoke alarm (12K) comprises a main monitor fire/smoke alarm microprocessor (12KC) electronically connected to the main monitor microprocessor (12F), a main monitor fire/smoke alarm sniffer (12KA) electronically connected to the main monitor fire/smoke alarm microprocessor (12KC), and a main monitor fire/smoke alarm analyzer (12KB) electronically connected to the main monitor fire/smoke alarm microprocessor (12KC).

5. The improved safety monitor (10) as described in claim 1, wherein the main monitor (12) further comprises a main monitor handle (12L) which functions to facilitate portability.

6. The improved safety monitor (10) as described in claim 1, wherein the remote monitor (14) power means is a remote monitor battery (14I) having a remote monitor battery positive lead (14IA) and a remote monitor battery negative lead (14IB).

7. The improved safety monitor (10) as described in claim 1 further comprises a charger base (16) having a charger base horizontal member (16H) securely fastened to a charger base vertical member (16I), the charger base horizontal member (16H) has a charger base main monitor holder (16D) and a charger base remote monitor holder (16E) therein which function to hold the main monitor (12) and the remote monitor (14), respectively, the charger base (16) further functions to electronically charge the main monitor battery (12I) and the remote monitor battery (14I).

8. The improved safety monitor (10) as described in claim 7, wherein the charger base (16) comprises a charger base plug (16G) which is electrically connectable to a standard power source, a charger base converter (16F) is electrically connected to the charger base plug (16G), a charger base switch (16B) having charger base switch indicia (16BA) is electrically connected between the to the charger base converter (16F) and the charger base plug (16G), a charger base indicator light (16A) is electrically connected to the charger base converter (16F), a charger base light (16C) having a charger base light photo cell (16CA) is electrically connected to the charger base converter (16F), a charger base main monitor holder positive lead (16DA) and a charger base main monitor holder negative lead (16DB) are electrically connected to the charger base converter (16F), a charger base remote monitor holder positive lead (16EA) and a charger base remote monitor holder negative lead (16EB) are electrically connected to the charger base converter (16F).

9. The improved safety monitor (10) as described in claim 8 is manufactured from a group of materials consisting of metal, metal alloy, plastic, plastic composite, rubber, and rubber composite.

10. The improved safety monitor (10) as described in claim 9, wherein the material has a color selected from a group of colors consisting of pastel, primary, and florescent.

11. The improved safety monitor (10) as described in claim 1, wherein the main monitor antenna (12D) and the remote monitor antenna (14D) are flexible.

* * * * *